US005330706A

United States Patent [19]

Ohdake et al.

[11] Patent Number: 5,330,706

[45] Date of Patent: Jul. 19, 1994

[54] VIBRATION-DAMPING ALLOY OF HIGH STRENGTH

[75] Inventors: Takayuki Ohdake; Toshimichi Ohmori; Toshihiro Takamura; Takemi Yamada; Tetsuya Sampei, all of Tokyo, Japan

[73] Assignee: NKK Corporation, Tokyo, Japan

[21] Appl. No.: 847,057

[22] PCT Filed: Aug. 2, 1991

[86] PCT No.: PCT/JP91/01037

§ 371 Date: Apr. 2, 1992

§ 102(e) Date: Apr. 2, 1992

[87] PCT Pub. No.: WO92/02653

PCT Pub. Date: Feb. 20, 1992

[30] Foreign Application Priority Data

Aug. 4, 1990 [JP] Japan ..... 2-207105

[51] Int. Cl.[5] ..... C22C 38/06; C22C 38/02

[52] U.S. Cl. ..... 420/103; 420/77; 420/78; 420/117

[58] Field of Search ..... 420/73, 103, 4, 77, 420/78, 117

[56] References Cited

FOREIGN PATENT DOCUMENTS

| | | | |
|---|---|---|---|
| 46-25139 | 7/1971 | Japan | 420/78 |
| 49-22328 | 2/1974 | Japan . | |
| 50-35020 | 4/1975 | Japan | 420/103 |
| 50-70212 | 6/1975 | Japan . | |
| 51-6119 | 1/1976 | Japan . | |
| 52-803 | 1/1977 | Japan . | |
| 56-28982 | 7/1981 | Japan . | |
| 60-52559 | 3/1985 | Japan | 420/78 |
| 60-52562 | 3/1985 | Japan | 420/78 |

*Primary Examiner*—Deborah Yee

*Attorney, Agent, or Firm*—Nields & Lemack

[57] ABSTRACT

It is an object to provide a vibration-damping alloy of high strength which has high strength and a high power of damping vibration and can be used to make components of a structure, machine, etc. and reduce effectively any vibration thereof and the noise thereby produced.

The vibration-damping alloy of this invention contains more than 0.50 wt. % Si, those proportions of Al and Si which fall within the range defined by a series of points in any of FIGS. 1 to 5, and that proportion of Mn which ranges from 0.1 wt. % to the sum of the proportions of Al and Si, the balance of its composition being Fe and unavoidable impurities. It preferably does not contain more than 0.01 wt. % of any of C, N, O, P and S.

5 Claims, 6 Drawing Sheets

VIBRATION-DAMPING ALLOY OF HIGH STRENGTH

TECHNICAL FIELD

This invention relates to a vibration-damping alloy of high strength which has a high power of damping vibration, and which can be used to make components of structures, machines, etc. and reduce effectively the vibration thereof and the noise thereby produced.

BACKGROUND ART

The vibration and noise which occur in our living environment have been pointed out as one of the causes of public nuisance. An increase in the accuracy required of a precision machine has given rise to the necessity for providing means for preventing the vibration of the machine itself. One of the approaches which have hitherto been made to cope with those problems and requirements is to use a material having an outstandingly high power of damping vibration (a vibration-damping material) for making any component that is a source of vibration.

There have been developed a number of alloys which are macroscopically uniform and have a high power of damping vibration. The main examples thereof are flake graphite cast iron, some iron-based alloys, a Mg-Ni alloy, Cu-Mn alloys and a Ni-Ti alloy. The iron-based alloy can be said from the standpoints of strength and cost to be practically the best material for any parts that are used in a large quantity.

The known iron-based alloys include an Fe-Al alloy as proposed in Japanese Patent Publication No. 803/1977. This alloy is claimed to have a high power of damping vibration if it contains 2 to 8% Al. Japanese Patent Publication No. 28982/1981 proposes an iron-based alloy containing 0.4 to 4% Si and 0.1 to 1.5% Mn, and having a ferrite grain size number of 5 or below, and states that the Si and Mn which it contains fix N to eliminate any hindrance to the motion of dislocations which absorb vibration energy.

The vibration-damping properties of the known alloys as hereinabove described are, however, not necessarily satisfactory for the recent requirements which call for a very high level of vibration damping.

Under these circumstances, I, the inventor of this invention, have found that an alloy made by adding a specific proportion of Al or Si, or particularly both, to Fe exhibits an outstandingly high power of damping vibration which has hitherto not been possible.

DISCLOSURE OF THE INVENTION

The vibration-damping alloy of this invention which is based on the above discovery has the composition which will hereunder be set forth:

(1) A vibration-damping alloy of high strength containing those proportions of Al and Si which fall within the range defined in FIG. 1 by the lines connecting points $A_4$(Al: 7.05 wt. %; Si: 0.95 wt. %), $B_4$(Al: 6.5 wt. %; Si: 1.10 wt. %), $C_4$(Al: 4.70 wt. %; Si: 2.75 wt. %), $D_4$(Al: 2.25 wt. %; Si: 2.45 wt. %), $E_4$(Al: 1.00 wt. %; Si: 3.60 wt. %), $F_4$(Al: 1.00 wt. %; Si: more than 0.50 wt. %) and $G_4$(Al: 7.50 wt. %; Si: more than 0.50 wt. %), said proportion of Si being more than 0.50 wt. %, and that proportion of Mn which ranges from at least 0.1 wt. % to the sum of said proportions of Al and Si, the balance of its composition being Fe and unavoidable impurities;

(2) A vibration-damping alloy of high strength containing those proportions of Al and Si which fall within the range defined in FIG. 2 by the lines connecting points $A_6$(Al: 7.45 wt. %; Si: 0.55 wt. %), $B_6$(Al: 3.30 wt. %; Si: 1.50 wt. %), $C_6$(Al: 1.00 wt. %; Si: 2.75 wt. %), $D_6$(Al: 1.00 wt. %; Si: more than 0.50 wt. %) and $E_6$(Al: 7.50 wt. %; Si: more than 0.50 wt. %), said proportion of Si being more than 0.50 wt. %, and that proportion of Mn which ranges from at least 0.1 wt. % to the sum of said proportions of Al and Si, the balance of its composition being Fe and unavoidable impurities;

(3) A vibration-damping alloy of high strength containing those proportions of Al and Si which fall within the range defined in FIG. 3 by the lines connecting points $A_8$(Al: 5.35 wt. %; Si: more than 0.50 wt. %), $B_8$(Al: 5.35 wt. %; Si: 0.80 wt. %), $C_8$(Al: 3.30 wt. %; Si: 1.00 wt. %), $D_8$(Al: 2.30 wt. %; Si: 1.40 wt. %), $E_8$(Al: 1.00 wt. %; Si: 2.35 wt. %) and $F_8$(Al: 1.00 wt. %; Si: more than 0.50 wt. %), said proportion of Si being more than 0.50 wt. %, and that proportion of Mn which ranges from at least 0.1 wt. % to the sum of said proportions of Al and Si, the balance of its composition being Fe and unavoidable impurities;

(4) A vibration-damping alloy of high strength containing those proportions of Al and Si which fall within the range defined in FIG. 4 by the lines connecting points $A_{10}$(Al: 4.60 wt. %; Si: more than 0.50 wt. %), $B_{10}$(Al: 4.60 wt. %; Si: 0.70 wt. %), $C_{10}$(Al: 3.20 wt. %; Si: 0.90 wt. %), $D_{10}$(Al: 2.55 wt. %; Si: 1.15 wt. %), $E_{10}$(Al: 1.00 wt. %; Si: 2.15 wt. %) and $F_{10}$(Al: 1.00 wt. %; Si: more than 0.50 wt. %), said proportion of Si being more than 0.50 wt. %, and that proportion of Mn which ranges from at least 0.1 wt. % to the sum of said proportions of Al and Si, the balance of its composition being Fe and unavoidable impurities; or (5) A vibration-damping alloy of high strength containing those proportions of Al and Si which fall within the range defined in FIG. 5 by the lines connecting points $A_{12}$(Al: 4.00 wt. %; Si: more than 0.50 wt. %), $B_{12}$(Al: 4.00 wt. %; Si: 0.70 wt. %), $C_{12}$(Al: 2.40 wt. %; Si: 0.95 wt. %), $D_{12}$(Al: 1.00 wt. %; Si: 1.90 wt. %), $E_{12}$(Al: 1.00 wt. %; Si: 1.30 wt. %) and $F_{12}$(Al: 2.05 wt. %; Si: more than 0.50 wt. %), said proportion of Si being more than 0.50 wt. %, and that proportion of Mn which ranges from at least 0.1 wt. % to the sum of said proportions of Al and Si, the balance of its composition being Fe and unavoidable impurities.

DETAILED DESCRIPTION OF THE INVENTION

The following is an explanation of the reasons for the limitations made on the composition of the alloy according to this invention.

Figure 6:
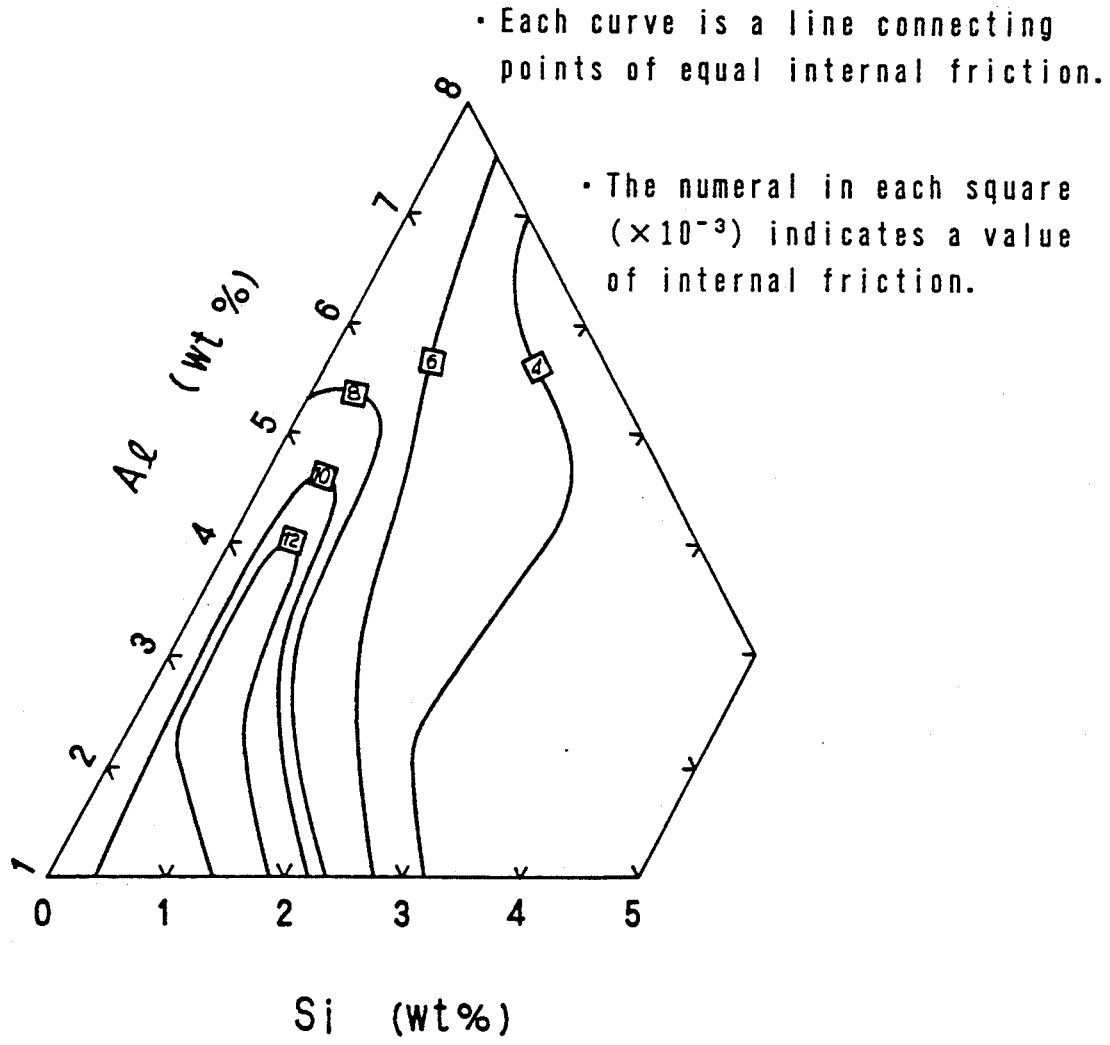
FIG. 6 is a diagram showing by contour lines the values of internal friction as determined of Fe-Al-Si alloys.

Most of the iron-based vibration-damping alloys rely for the absorption of vibrational energy upon the magneto-mechanical hysteresis resulting from the irreversible movement of magnetic domain walls by vibration. This characteristic is closely related to the magnetic properties of the alloy. On the other hand, it is known that the magnetic properties, such as permeability, of the Fe-Al-Si ternary alloys vary characteristically with their difference in composition, as was, for example, reported by Yamamoto in the Collection of Papers of The Society of Electrical Engineering, vol. 5 (1944), page 175. The values of internal friction ($Q^{-1}$) of these alloys were determined as a measure of their vibration-damping properties, and the results as shown in FIG. 6 were obtained. It is obvious therefrom that the addition of specific proportions of Al and Si to Fe enables so high vibration-damping properties as cannot be attained by the addition of only one of them.

The vibration-damping alloys are used almost exclusively for making structural members or components of machines, and are, as such, required to possess at least the minimum level of strength as specified by JIS. That is why this invention defines the alloy as containing at least 1 wt. % Al. Therefore, the tests of which the results are shown in FIG. 6 were conducted on alloys containing about 1.2 wt. % Mn, excluding those containing 1 wt. % or less Al.

Silicon can stabilize the vibration-damping properties of the alloy. Even if the proportions of Al and Si are within the ranges shown in FIG. 6, a slight variation in the composition of the alloy brings about a great difference in its properties if the proportion of Si is not more than 0.5 wt. %. Therefore, the proportion of Si is defined as more than 0.5 wt. %.

Figure 1:
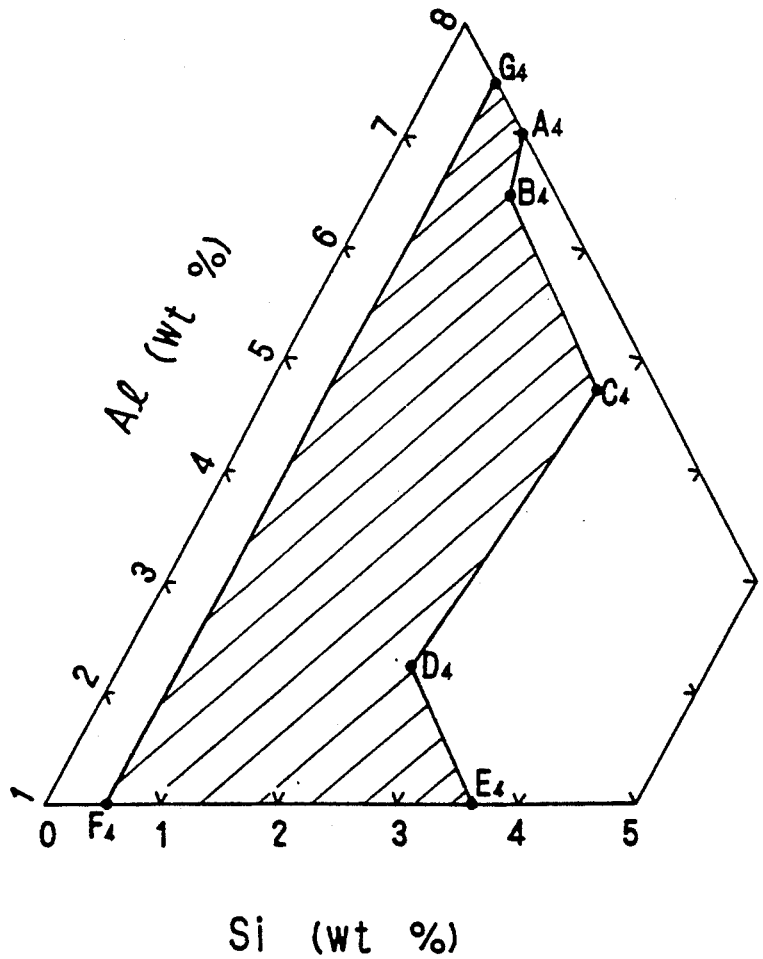
FIGS. 1 to 5 are diagrams defining the ranges of proportions of Al and Si in the alloy of this invention.
Figure 2:
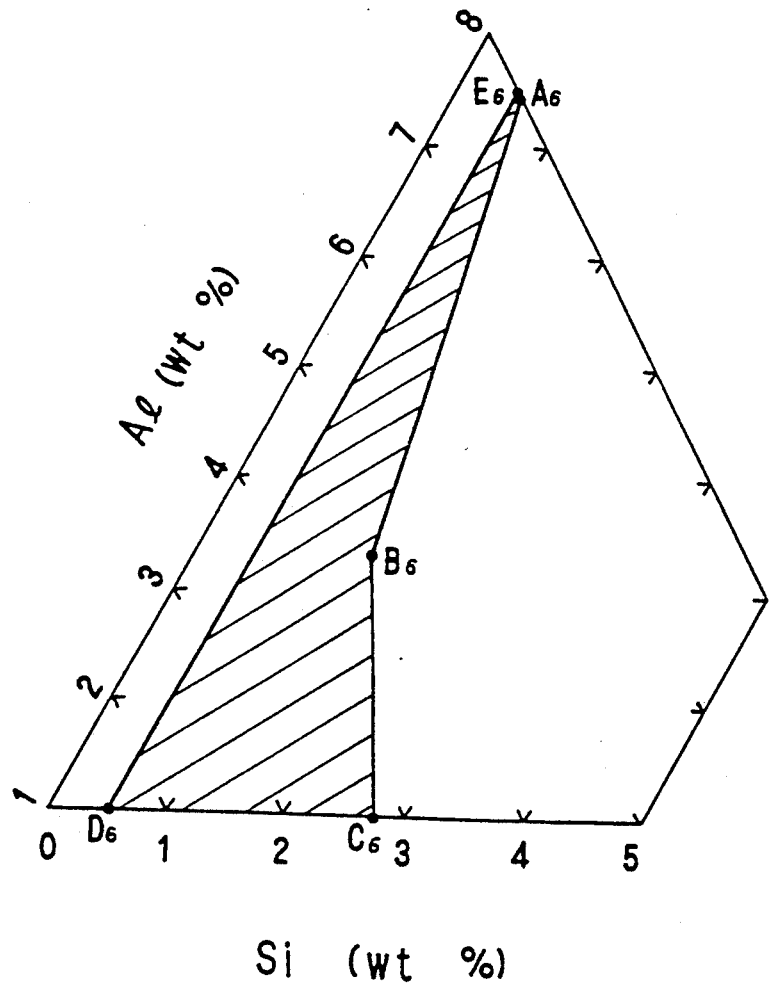
Figure 3:
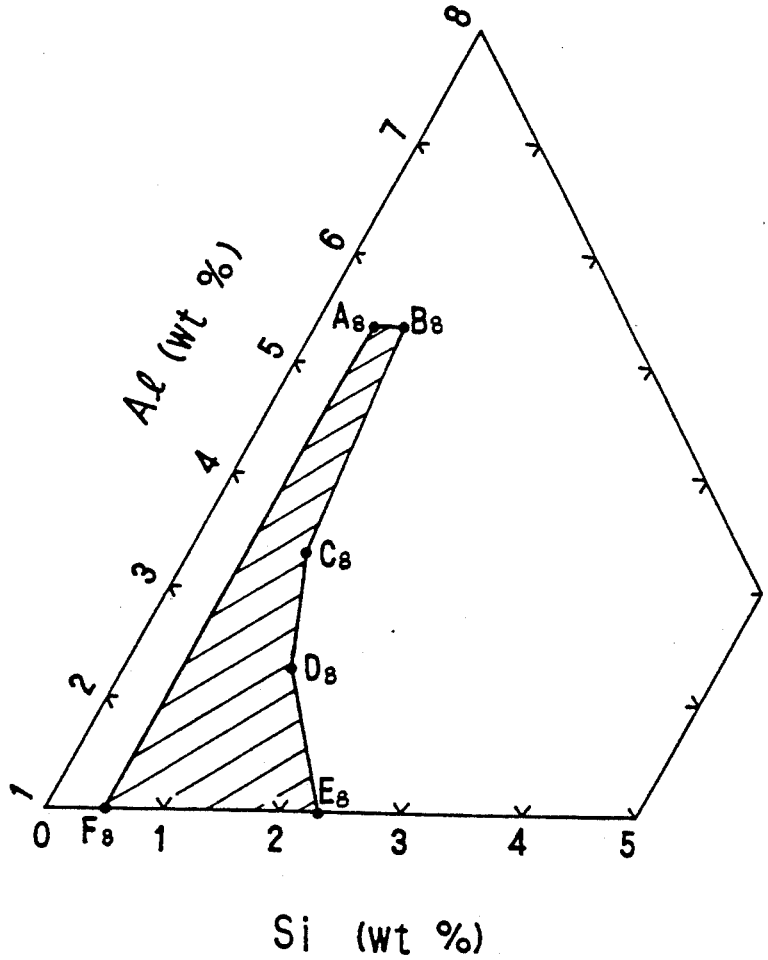
Figure 4:
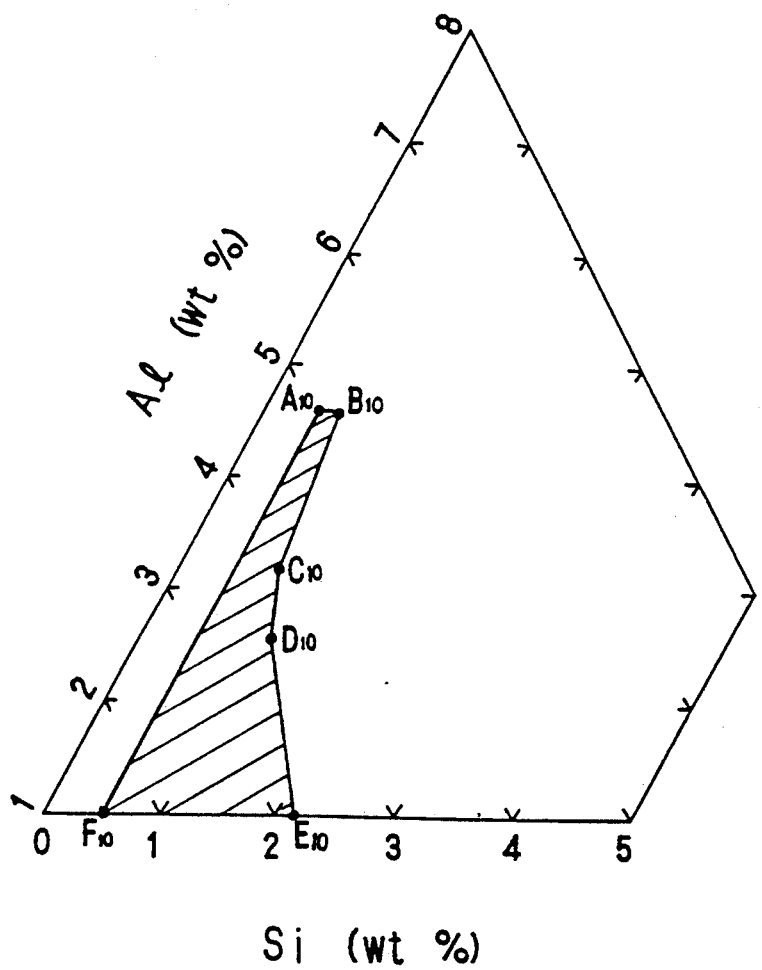
Figure 5:
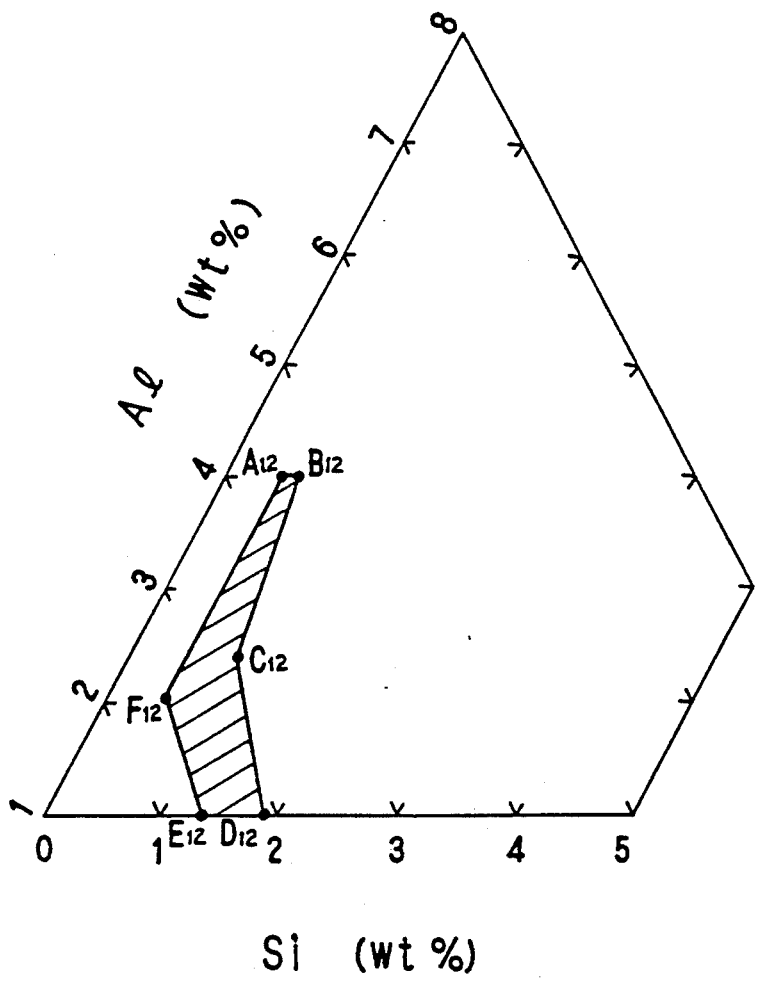

Based on the above results, this invention specifies the proportions of Al and Si as defined in FIG. 1 to attain a $Q^{-1}$ value exceeding $4\times10^{-3}$ as the vibration-damping properties of the alloy (the value of its internal friction), as defined in FIG. 2 to attain a $Q^{-1}$ value exceeding $6\times10^{-3}$, as defined in FIG. 3 to attain a $Q^{-1}$ value exceeding $8\times10^{-3}$, as defined in FIG. 4 to attain a $Q^{-1}$ value exceeding $1.0\times10^{-2}$, and as defined in FIG. 5 to attain a $Q^{-1}$ value exceeding $1.2\times10^{-2}$.

Manganese is an antiferromagnetic element, and though it is of no use in improving the vibration-damping properties of the alloy, it is added in the proportion of at least 0.1 wt. % to ensure the strength of the alloy. The addition of too large a proportion of Mn is, however, expected to bring about a reduction in the vibration-damping properties of the alloy. TABLE 2 shows the results of examination made to see what effects the proportion of Mn would have on the vibration-damping properties of the alloy. As is obvious therefrom, there is no reduction in the vibration-damping properties if the proportion of Mn is not larger than the sum of the proportions of Al and Si. Therefore, the proportion of Mn is defined as ranging from 0.1 wt. % to the sum of the proportions of Al and Si.

Limitations are also desirable on the other impurities for the reasons which will hereunder be set forth.

It is desirable to keep C at not more than 0.01 wt. %, since it is an element forming an interstitial solid solution and lowers the mobility of the magnetic domain walls and thereby the vibration-damping properties of the alloy.

It is also desirable to keep N at not more than 0.01 wt. %, since it lowers the vibration-damping properties of the alloy for the same reason as has been mentioned above with respect to carbon.

It is also desirable to keep O at not more than 0.01 wt. %, since it lowers the vibration-damping properties as C and N do.

It is desirable to keep P at not more than 0.01 wt. %, since it is segregated in the grain boundary of the alloy and lowers its workability.

It is desirable to keep S at not more than 0.01 wt. %, since it lowers the hot workability of the alloy.

As is obvious from the foregoing, the alloy of this invention has outstandingly high vibration-damping properties and strength and is useful as a material for preventing vibration and noise.

EXAMPLES

The values of internal friction, $Q^{-1}$, of the alloys of this invention and comparative alloys having the chemical compositions shown in TABLE 1 (which contained 10 to 30 ppm of C and 2 to 26 ppm of N) were determined as a measure of their vibration-damping properties. An ingot of each alloy made by casting the molten alloy in a mold had been heated to a temperature of 1200° C. to 1250° C. and hot rolled into a thickness of 6 mm. A sheet having a thickness of 0.8 mm, a width of 10 mm and a length of 100 mm had been cut from the rolled product, and annealed at 1050° C. in a vacuum to provide a specimen of each alloy. The specimen was caused to vibrate with free-free transverse vibration method in a vacuum, free vibration decay method was used to determine its internal friction. The results are shown in TABLE 1.

FIG. 6 is a representation by contour lines of the values of internal friction of the Fe-Al-Si ternary alloys which are shown in TABLE 1. Each curve was drawn by plotting points of equal internal friction, and the numeral appearing in the square on each curve indicates the value of internal friction if it is multiplied by $10^{-3}$.

TABLE 2 shows the results of examination made to see the effects which different proportions of Mn in alloys would have on their vibration-damping properties. Specimens were prepared by repeating the process as described above, and the values of internal friction as a measure of their vibration-damping properties were determined by repeating the method as described above.

TABLE 1

| No. | Chemical composition (wt %) Al | Si | Mn | Internal friction $Q^{-1}$ ($\times 10^{-3}$) | Tensile strength (kgf/mm$^2$) |
|---|---|---|---|---|---|
| 1 | 1.23 | 0.01 | 1.19 | 8.61 | 40.4 |
| 2 | 3.30 | 0.01 | 1.05 | 9.54 | 46.9 |
| 3 | 4.69 | 0.01 | 1.10 | 8.42 | 52.2 |
| 4 | 7.51 | 0.01 | 1.37 | 6.30 | 63.4 |
| 5 | 1.23 | 0.20 | 1.14 | 8.71 | 42.7 |
| 6 | 1.23 | 0.52 | 1.05 | 11.2 | 45.8 |
| 7 | 2.40 | 0.52 | 1.29 | 14.2 | 51.2 |
| 8 | 3.29 | 0.51 | 1.23 | 17.9 | 54.0 |
| 9 | 4.88 | 0.52 | 1.16 | 9.09 | 59.2 |
| 10 | 1.23 | 0.98 | 1.09 | 11.7 | 45.6 |
| 11 | 3.32 | 1.12 | 1.32 | 6.84 | 55.6 |
| 12 | 4.90 | 1.14 | 1.13 | 5.98 | 60.5 |
| 13 | 6.93 | 1.06 | 1.20 | 4.00 | 66.7 |
| 14 | 1.22 | 1.52 | 1.18 | 14.2 | 58.3 |
| 15 | 1.25 | 2.43 | 1.20 | 7.55 | 68.9 |
| 16 | 2.26 | 2.50 | 1.11 | 3.95 | 72.4 |
| 17 | 4.65 | 2.53 | 1.35 | 4.11 | 84.4 |
| 18 | 1.24 | 3.55 | 0.27 | 2.81 | 82.6 |

TABLE 2

| No. | Chemical composition (wt %) Al | Si | Mn | % Mn/ (% Al + % Si) | Internal friction $Q^{-1}$ ($\times 10^{-3}$) | Tensile strength (kgf/mm$^2$) |
|---|---|---|---|---|---|---|
| 1 | 1.23 | 0.03 | 0.01 | 0.008 | 9.99 | 34.8 |
| 2 | 1.23 | 0.01 | 1.19 | 0.96 | 8.61 | 40.8 |
| 3 | 1.22 | 0.01 | 1.42 | 1.15 | 2.21 | 41.8 |
| 4 | 2.35 | 0.50 | 0.01 | 0.004 | 10.7 | 44.7 |
| 5 | 2.40 | 0.52 | 1.29 | 0.44 | 14.2 | 51.1 |
| 6 | 2.37 | 0.52 | 3.09 | 1.07 | 3.17 | 60.2 |
| 7 | 1.25 | 1.54 | 0.01 | 0.004 | 15.3 | 52.6 |
| 8 | 1.22 | 1.52 | 1.18 | 0.43 | 14.2 | 58.3 |
| 9 | 1.23 | 1.51 | 3.27 | 1.19 | 2.18 | 68.6 |

INDUSTRIAL UTILITY

The alloy of this invention is useful as a material for any component of a structure, machine, or the like that is required to be strong, and not to produce any vibration, or noise.

What is claimed is:

1. A vibration-damping alloy of high strength containing not more than 0.01 wt. % C, not more than 0.01 wt. % N, not more than 0.01 wt. % O, not more than 0.01 wt. % P, not more than 0.01 wt. % S, more than 0.50 wt. % Si, those proportions of Al and Si which fall within the range defined in FIG. 1 by the lines connecting points $A_4$(Al: 7.05 wt. %; Si: 0.95 wt. %), $B_4$(Al: 6.5 wt. %; Si: 1.10 wt. %), $C_4$(Al: 4.70 wt. %; Si: 2.75 wt. %), $D_4$(Al: 2.25 wt. %; Si: 2.45 wt. %), $E_4$(Al: 1.00 wt. %; Si: 3.60 wt. %), $F_4$(Al: 1.00 wt. %; Si: more than 0.50 wt. %) and $G_4$(Al: 7.50 wt. %; Si: more than 0.50 wt. %), and that proportion of Mn which ranges from 0.1 wt. % to the sum of said proportions of Al and Si, the balance of its composition being Fe and unavoidable impurities.

2. A vibration-damping alloy of high strength containing not more than 0.01 wt. % C, not more than 0.01 wt. % N, not more than 0.01 wt. % O, not more than 0.01 wt. % P, not more than 0.01 wt. % S, more than 0.50 wt. % Si, those proportions of Al and Si which fall within the range defined in FIG. 2 by the lines connecting points $A_6$(Al: 7.45 wt. %; Si: 0.55 wt. %), $B_6$(Al: 3.30 wt. %; Si: 1.50 wt. %), $C_6$(Al: 1.00 wt. %; Si: 2.75 wt. %), $D_6$(Al: 1.00 wt. %; Si: more than 0.50 wt. %) and $E_6$(Al: 7.50 wt. %; Si: more than 0.50 wt. %), and that proportion of Mn which ranges from 0.1 wt. % to the sum of said proportions of Al and Si, the balance of its composition being Fe and unavoidable impurities.

3. A vibration-damping alloy of high strength containing not more than 0.01 wt. % C, not more than 0.01 wt. % N, not more than 0.01 wt. % O, not more than 0.01 wt. % P, not more than 0.01 wt. % S, more than 0.50 wt. % Si, those proportions of Al and Si which fall within the range defined in FIG. 3 by the lines connecting points $A_8$(Al: 5.35 wt. %; Si: more than 0.50 wt. %), $B_8$(Al: 5.35 wt. %; Si: 0.80 wt. %), $C_8$(Al: 3.30 wt. %; Si: 1.00 wt. %), $D_8$(Al: 2.30 wt. %; Si: 1.40 wt. %), $E_8$(Al: 1.00 wt. %; Si: 2.35 wt. %), and $F_8$(Al: 1.00 wt. %; Si: more than 0.50 wt. %), and that proportion of Mn which ranges from 0.1 wt. % to the sum of said proportions of Al and Si, the balance of its composition being Fe and unavoidable impurities.

4. A vibration-damping alloy of high strength containing not more than 0.01 wt. % C, not more than 0.01 wt. % N, not more than 0.01 wt. % O, not more than 0.01 wt. % P, not more than 0.01 wt. % S, more than 0.50 wt. % Si, those proportions of Al and Si which fall within the range defined in FIG. 4 by the lines connecting points $A_{10}$(Al: 4.60 wt. %; Si: more than 0.50 wt. %), $B_{10}$(Al: 4.60 wt. %; Si: 0.70 wt. %), $C_{10}$(Al: 3.20 wt. %; Si: 0.90 wt. %), $D_{10}$(Al: 2.55 wt. %; Si: 1.15 wt. %), $E_{10}$(Al: 1.00 wt. %; Si: 2.15 wt. %), and $F_{10}$(Al: 1.00 wt. %; Si: more than 0.50 wt. %), and that proportion of Mn which ranges from 0.1 wt. % to the sum of said proportions of Al and Si, the balance of its composition being Fe and unavoidable impurities.

5. A vibration-damping alloy of high strength containing not more than 0.01 wt. % C, not more than 0.01 wt. % N, not more than 0.01 wt. % O, not more than 0.01 wt. % P, not more than 0.01 wt. % S, more than 0.50 wt. % Si, those proportions of Al and Si which fall within the range defined in FIG. 5 by the lines connecting points $A_{12}$(Al: 4.00 wt. %; Si: more than 0.50 wt. %), $B_{12}$(Al: 4.00 wt. %; Si: 0.70 wt. %), $C_{12}$(Al: 2.40 wt. %; Si: 0.95 wt. %), $D_{12}$(Al: 1.00 wt. %; Si: 1.90 wt. %), $E_{12}$(Al: 1.00 wt. %; Si: 1.30 wt. %), and $F_{12}$(Al: 2.05 wt. %; Si: more than 0.50 wt. %), and that proportion of Mn which ranges from 0.1 wt. % to the sum of said proportions of Al and Si, the balance of its composition being Fe and unavoidable impurities.

* * * * *